US005485247A

United States Patent [19]

Morishita et al.

[11] Patent Number: 5,485,247

[45] Date of Patent: Jan. 16, 1996

[54] IMAGE FORMING APPARATUS INCLUDING A PAPER FEEDING DEVICE HAVING IMPROVED PAPER JAM DETECTION CAPABILITY

[75] Inventors: Hiroki Morishita; Hiroaki Nakamura; Makoto Eki; Yoshinori Makiura; Masao Otsuka; Kazushiro Taguchi; Keiji Ban, all of Osaka, Japan

[73] Assignee: Mita Industrial Co., Ltd., Japan

[21] Appl. No.: 105,929

[22] Filed: Aug. 13, 1993

[30] Foreign Application Priority Data

Aug. 28, 1992 [JP] Japan ..... 4-230273

[51] Int. Cl.[6] ..... G03G 21/00

[52] U.S. Cl. ..... 355/205; 271/259; 271/265.02; 355/309; 355/316

[58] Field of Search ..... 355/205, 206, 355/207, 316, 309, 308; 271/259, 264, 265.01, 265.02

[56] References Cited

U.S. PATENT DOCUMENTS

| | | | |
|---|---|---|---|
| 4,084,900 | 4/1978 | Yamaoka et al. | 355/206 |
| 4,395,111 | 7/1983 | Takahashi et al. | 355/206 |
| 4,937,622 | 6/1990 | Makiura | 355/316 X |
| 5,012,281 | 4/1991 | Kusumoto et al. | 355/206 |

FOREIGN PATENT DOCUMENTS

| | | | |
|---|---|---|---|
| 56-24364 | 3/1981 | Japan | 355/309 |
| 58-142360 | 8/1983 | Japan | 355/309 |
| 58-198059 | 11/1983 | Japan | 355/309 |
| 60-247656 | 12/1985 | Japan | 355/309 |

*Primary Examiner*—A. T. Grimley
*Assistant Examiner*—Shuk Y. Lee
*Attorney, Agent, or Firm*—Beveridge, DeGrandi, Weilacher & Young

[57] ABSTRACT

A paper feeding device is capable of judging that a paper jam occurs on the basis of output from a first paper detecting switch and a second paper detecting switch. These paper detecting switches are respectively provided ahead of and behind a registration roller which feeds paper sheets to an image forming section. If the first paper detecting switch is turned on when a predetermined time has elapsed since the registration roller started to feed a paper sheet to the image forming section, it is judged that a duplicate paper feeding state has occurred where a plurality of paper sheets are simultaneously fed. If the second paper detecting switch is turned off in the case where it is judged that a duplicate paper feeding state has occurred, it is judged that a paper jam has not occurred. The registration roller is stopped so it will later be ready to feed the subsequent paper sheet. Even when the paper sheets are simultaneously fed in a duplicate paper feeding state, it is not judged that a paper jam occurs as long as the paper sheets are fed one at a time to the image forming section. However, if both the first and second paper detecting switches remain on after the predetermined time, then it is judged that a paper jam has occurred.

13 Claims, 5 Drawing Sheets

IMAGE FORMING APPARATUS INCLUDING A PAPER FEEDING DEVICE HAVING IMPROVED PAPER JAM DETECTION CAPABILITY

CROSS REFERENCE TO RELATED APPLICATIONS

This application claims priority benefits under 35 USC §119 of Japanese Patent Application Serial No. 4-230273, filed on Aug. 28, 1992, the disclosure of which is incorporated herein by reference.

BACKGROUND OF THE INVENTION

1. Field of the Invention

The present invention relates to a paper feeding device used for feeding paper sheets in an image forming apparatus, such as a printer or a copying machine.

2. Description of the Related Art

In a printer, a copying machine or the like for recording an image in accordance with an electrophotographic process, the image is recorded in the following manner. Specifically, an electrostatic latent image corresponding to an image to be formed is formed on the surface of a photoreceptor. The electrostatic latent image is developed into a toner image. This toner image is transferred onto a paper sheet and is further fixed thereto. Consequently, image formation is achieved.

Such an image forming apparatus is provided with a paper feeding device for feeding paper sheets to the photoreceptor at a predetermined timing. The paper feeding device comprises, for example, a paper feeding cassette containing paper sheets, a paper feeding roller for taking a paper sheet from the paper feeding cassette, and a pair of registration rollers for stopping the paper sheet taken out by the paper feeding roller short of the photoreceptor and feeding the paper sheet to the photoreceptor a predetermined timing.

Such a paper feeding device generally has a paper detecting switch provided on a paper conveying path on the upstream side of the registration rollers with respect to the paper conveyance direction, that is, between the registration rollers and the paper feeding roller. This paper detecting switch is turned on when the paper sheet passes through the position where it is provided, to generate a predetermined signal. It is possible to judge that a paper jam has occurred between the registration rollers and the paper feeding roller on the basis of the output of the paper detecting switch. Specifically, when the paper detecting switch is held in an ON state over a time longer than the time required for the paper sheet to pass through the paper detecting switch after the registration rollers are driven, it is judged that a paper jam has occurred. When it is judged that a paper jam has occurred, the image forming apparatus stops operating. In order to restart the image forming apparatus, it is necessary to remove the paper sheet which is the cause of the judgment that a paper jam has occurred.

Paper sheets are not always fed one at a time by the paper feeding roller. Specifically, in some cases, a plurality of, paper sheets(e.g., two sheets) may be fed at one time from the paper feeding cassette by the paper feeding roller, that is, there may occur a so-called duplicate paper feeding state.

When the paper sheets are thus simultaneously fed in a duplicate paper feeding state from the paper feeding cassette, the two paper sheets may, in some cases, be simultaneously fed to the photoreceptor through the registration rollers. Alternatively, one of the two paper sheets may, in some cases, be stopped just short of the registration rollers. That is, only the first paper sheet out of the paper sheets which are simultaneously fed may be conveyed by the registration rollers, and the second paper sheet may be stopped just short of the registration rollers. In this case, even after the first paper sheet passes through the registration rollers, the paper detecting switch continues being in an ON state because of the presence of the second paper sheet. Consequently, it is erroneously judged that a paper jam has occurred between the registration rollers, and the paper feeding roller irrespective of the fact that a paper jam does not substantially occur.

However, the second paper sheet which is the cause of the erroneous judgment that a paper jam has occurred is not particularly damaged. The paper sheet can be safely fed to the photoreceptor. Nevertheless, the image forming apparatus stops operating due to the erroneous judgment that a paper jam has occurred. In order to restart the image forming apparatus, therefore, the second paper sheet, which is not damaged must be removed. Consequently, it wastes time and labor, and paper sheets are wastefully used.

SUMMARY OF THE INVENTION

An object of the present invention is to provide a paper feeding device in an image forming apparatus improved in the reliability of the judgment that a paper jam has occurred.

Another object of the present invention is to provide a paper feeding device in an image forming apparatus capable of saving time and labor caused by the erroneous judgment that a paper jam has occurred.

Still another object of the present invention is to provide a paper feeding device in an image forming apparatus so adapted that paper sheets which are not damaged are reliably used for recording an image, to thereby prevent the waste of the undamaged paper sheets.

A further object of the present invention is to provide a paper jam judging method in an image forming apparatus by which the reliability of the judgment that a paper jam has occurred can be improved.

In a paper feeding device according to the present invention, a paper sheet is detected ahead of and behind a registration roller which is provided for feeding the paper sheet to an image forming section a predetermined timing. Specifically, a first detecting section is disposed on a paper conveying path on the upstream side of the registration roller with respect to the paper conveyance direction. In addition, a second detecting section is disposed on the paper conveying path on the downstream side of the registration roller with respect to the paper conveyance direction. The first detecting section and the second detecting section respectively detect the paper sheet which is being conveyed.

If the first detecting section detects the paper sheet when a predetermined time has elapsed since the registration roller started to feed the paper sheet, it is judged that a duplicate paper feeding state has occurred where a plurality of paper sheets are simultaneously fed to the registration roller.

When it is judged that a duplicate paper feeding state has occurred the second detecting section still detects a paper sheet, it is judged that a paper jam has occurred. On the other hand, when it is judged that a duplicate paper feeding state has occurred the second detecting section does not detect the paper sheet, it is not judged that a paper jam has occurred, so that the registration roller is stopped from feeding the subsequent paper sheet.

Even if a duplicate paper feeding state occurs, it is not judged that a paper jam has occurred only by the fact that a duplicate paper feeding state has occurred. Specifically, when the paper sheets pass through the registration roller one at a time, it is not erroneously judged that a paper jam has occurred. It is possible to satisfactorily feed all the plurality of paper sheets, which are simultaneously fed in a duplicate paper feeding state, to the image forming section.

Therefore, the reliability of the judgment that a paper jam has occurred is improved. In addition, it is possible to save the wasted time and labor of correcting the erroneous judgment that a paper jam has occurred. Furthermore, it is possible to reliably use the intact paper sheets for forming an image, so that paper sheets are not wasted.

The foregoing and other objects, features, aspects and advantages of the present invention will become more apparent from the following detailed description of the embodiments when taken in conjunction with the accompanying drawings.

DESCRIPTION OF PREFERRED EMBODIMENTS

Figure 1:
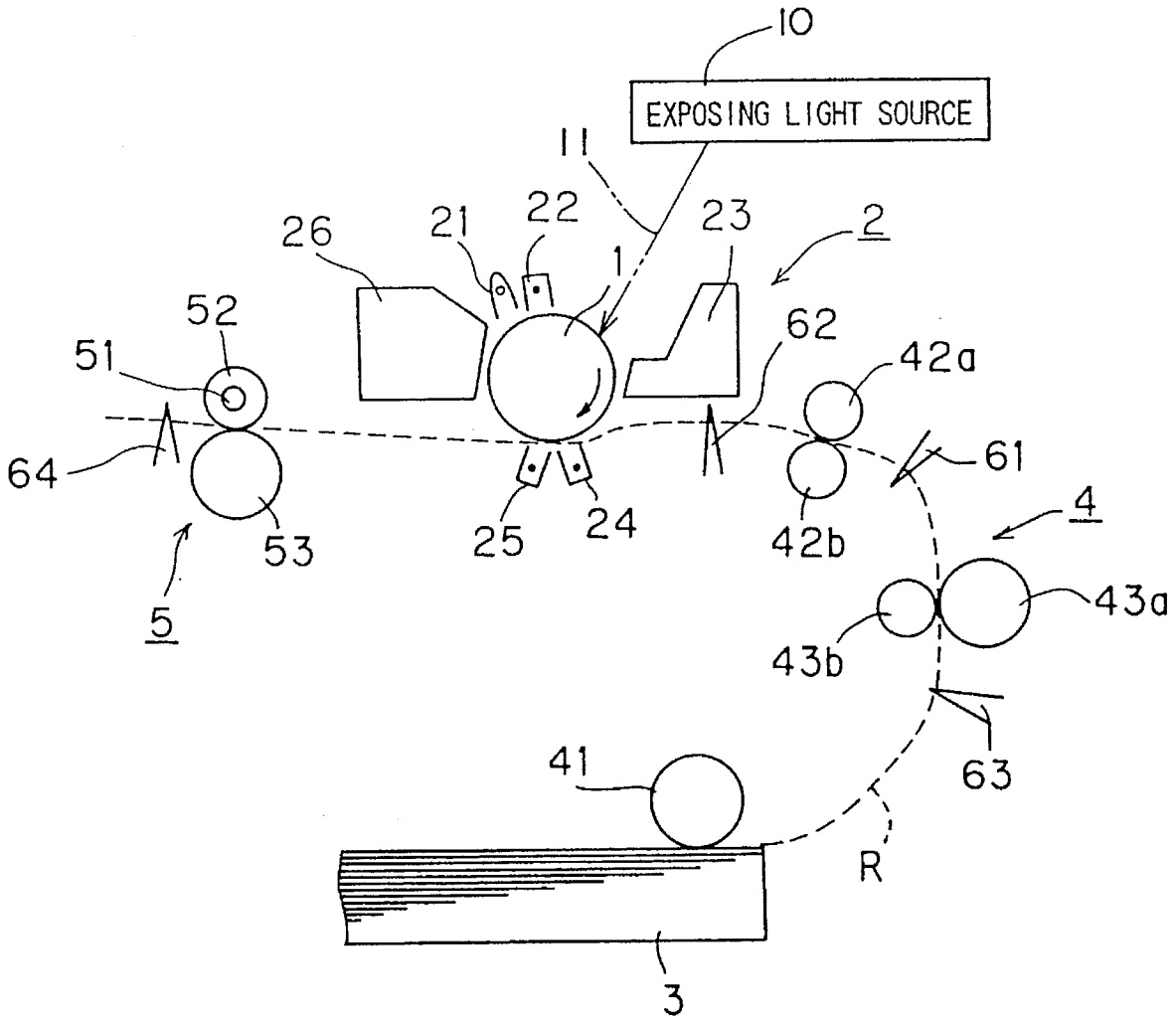
FIG. 1 is an illustration showing the schematic construction of a copying machine provided with a paper feeding device according to one embodiment of the present invention.

FIG. 1 is a diagram showing the schematic construction of a copying machine provided with a paper feeding device according to one embodiment of the present invention. In FIG. 1, only portions related to the present invention are illustrated. This copying machine comprises a photosensitive drum 1 on which an electrostatic latent image corresponding to an image to be formed is formed, an image forming section 2 for developing the electrostatic latent image formed on the photosensitive drum 1 into a toner image to transfer the toner image onto paper sheets, a paper feeding section 4 for feeding paper sheets in a paper feeding cassette 3 to the photosensitive drum 1 through a paper feeding path R, and a fixing section 5 for fixing the toner image transferred by the image forming section 2 to paper sheets.

The image forming section 2 comprises the photosensitive drum 1. A charge eliminating lamp 21 for eliminating charges on the surface of the photosensitive drum 1, a main charger 22 for uniformly charging the surface of the photosensitive drum 1, a developing device 23 for developing the electrostatic latent image formed on the surface of the photosensitive drum 1 into the toner image, a transferrer 24 for transferring the toner image onto paper sheets, a separator 25 for separating paper sheets from the surface of the photosensitive drum 1, and a cleaner 26 for removing toner on the surface of the photosensitive drum 1 are disposed around the photosensitive drum 1, in this order along the direction of rotation of the photosensitive drum 1. The transferrer 24 and the separator 25 respectively realize the respective functions by inducing corona discharges.

The surface of the photosensitive drum 1 uniformly charged by the main charger 22 is exposed to light 11 from an exposing light source 10. This exposure causes the charges on the surface of the photosensitive drum 1 to be selectively eliminated. As a result, an electrostatic latent image is formed.

For example, in an analog copying machine, an optical system for scanning a document while illuminating the same corresponds to the exposing light source 10. In this case, light reflected from the document becomes the light 11. In addition, in a digital copying machine, a laser light source or a light emitting diode array is used as the exposing light source 10. In this case, light output from the laser light source or the light emitting diode array corresponds to the light 11. The light output from the laser light source or the light emitting diode array is subjected to modulation corresponding to an image to be formed.

The paper feeding section 4 comprises a paper feeding roller 41 which comes into contact with the paper sheets loaded in the paper feeding cassette 3 from above for feeding the paper sheets in the paper feeding cassette 3 to a paper feeding path R. The paper sheet fed to the paper feeding path R by the paper feeding roller 41 is led to a pair of registration rollers 42*a* and 42*b* disposed between the paper feeding roller 41 and the photosensitive drum 1. The registration rollers 42*a* and 42*b* cause the paper sheet conveyed on the paper feeding path R to wait short of the photosensitive drum 1, so that the paper sheet may be feed to the photosensitive drum 1 at a timing synchronized with the rotation of the photosensitive drum 1. A pair of separation rollers 43*a* and 43*b* for separating paper sheets which are simultaneously fed in a duplicate paper feeding state by the paper feeding roller 41 is disposed between the registration rollers 42*a* and 42*b* and the paper feeding roller 41.

A first paper detecting switch 61 is disposed on the paper feeding path R on the upstream side of the registration rollers 42*a* and 42*b* with respect to the paper conveyance direction, that is, between the registration rollers 42*a* and 42*b* and the separation rollers 43*a* and 43*b*. This first paper detecting switch 61 is for detecting the presence or absence of a paper sheet in the position where the switch 61 is provided, which switch 61 is turned on when the paper sheet exists in the position where switch 61 is provided. Specifically, the first paper detecting switch 61 detects the paper sheet fed from the separation rollers 43*a* and 43*b* to the registration rollers 42*a* and 42*b*. The distance between the first paper detecting switch 61 and the photosensitive drum 1 is set to such a distance that the leading edge of the paper sheet is wound around the photosensitive drum 1 when the trailing edge of the paper sheet passes through the first paper detecting switch 61.

Furthermore, a second paper detecting switch 62 is disposed on the paper feeding path R on the downstream side of the registration rollers 42*a* and 42*b* with respect to the paper conveyance direction, that is, between the registration rollers 42*a* and 42*b* and the photosensitive drum 1. The second paper detecting switch 62 is turned on when the paper sheet exists in the position where the switch 62 is provided to detect the presence or absence of a paper sheet. Specifically, the second paper detecting switch 62 detects the paper sheet fed from the registration rollers 42*a* and 42*b* to the photosensitive drum 1.

Additionally, a duplicate paper feeding detecting switch 63 is disposed on the paper feeding path R between the paper feeding roller 41 and the separation rollers 43*a* and 43*b*. The duplicate paper feeding detecting switch 63 judges whether or not the paper sheets are simultaneously fed in a duplicate paper feeding state by the paper feeding roller 41.

The paper detecting switches 61 and 62 respectively have actuators which can be inclined. In FIG. 1, only the actuators of the paper detecting switches 61 and 62 are symbolically illustrated. When the actuators are inclined by the leading edge of the paper sheet, the paper detecting switches 61 and 62 are switched from an OFF state to an ON state. The actuators are returned to their original positions after the paper sheet has passed. As a result, the paper detecting switches 61 and 62 are switched from an ON state to an OFF state immediately after the paper sheet has passed.

The duplicate paper feeding detecting switch 63 has an actuator which can be inclined, similar to the paper detecting switches 61 and 62. When the leading edge of the paper sheet inclines the actuator, the duplicate paper feeding detecting switch 63 is switched from an OFF state to an 0N state. When the actuator returns to the original position after the paper sheet has passed, the duplicate paper feeding detecting switch 63 is switched from an ON state to an OFF state.

The separation rollers 43*a* and 43*b* comprise a large diameter roller 43*a* and a small diameter roller 43*b*. A driving force is applied to the separation rollers 43*a* and 43*b* in response to the switching of the duplicate paper feeding detecting switch 63 to an ON state. The application of the driving force to the separation rollers 43*a* and 43*b* is stopped at a time when the leading edge of the paper sheet reaches the registration rollers 43*a* and 43*b*. Specifically, at the time point when a predetermined time has elapsed after the leading edge of the paper sheet reaches the first paper detecting switch 61 to turn it on, it is deemed that the leading edge of the paper sheet reaches the registration rollers 42*a* and 42*b*. Then, the driving of the separation rollers 43*a* and 43*b* is stopped. At this time, the driving of the paper feeding roller 41 is also stopped.

The large diameter roller 43*a* contains a torque limiter, and a driving force in the direction in which paper sheets are fed to the paper feeding cassette 3 is applied to the large diameter roller 43*a*. Specifically, counterclockwise torque is applied to both the small diameter roller 43*b* and the large diameter roller 43*a* in FIG. 1. When only one paper sheet passes between the separation rollers 43*a* and 43*b*, the large diameter roller 43*a* moves in synchronism with the passage of the paper sheet by the function of the above described torque limiter. Specifically, the large diameter roller 43*a* rotates in the clockwise direction in FIG. 1. On the other hand, when two or more paper sheets are fed to the separation rollers 43*a* and 43*b*, the large diameter roller 43*a* is to be in a stationary state because a friction force between the paper sheets is small. Specifically, the paper sheet positioned on the side of the small diameter roller 43*b* is conveyed to the first paper detecting switch 61 by the small diameter roller 43*b*, and the paper sheet positioned on the side of the large diameter roller 43*a* is stopped.

The fixing section 5 comprises a heating roller 52 in which a heater lamp 51 is mounted, and a pressure roller 53 which presses to contact with the heating roller 52 from below. A third paper detecting switch 64 is disposed on a paper discharge path on the downstream side of the heating roller 52 and the pressure roller 53 with respect to the paper conveyance direction. This third paper detecting switch 64 is a switch which is turned on when the paper sheet exists in the position where the switch 64 is provided, which switch 64 detects the paper sheet which is discharged from the heating roller 52 and the pressure roller 53 toward a paper discharge tray (not shown).

The paper detecting switch 64 has an actuator so provided that it can be inclined, similar to the paper detecting switches 61 and 62. When the leading edge of the paper sheet inclines the actuator, the paper detecting switch 64 is switched from an OFF state to an ON state. When the actuator is returned to the original position after the paper sheet has passsed, the paper detecting switch 64 is switched from an 0N state to an OFF state.

The following will discuss the operations performed by the above described copying machine. The photosensitive drum 1 is rotated and driven at a predetermined speed in the direction indicated by an arrow in FIG. 1. The surface of the photosensitive drum 1 is charged to a predetermined potential by the main charger 22. An electrostatic latent image is formed on the surface of the photosensitive drum 1 by exposure to the light 11 from the exposing light source 10. Toner is then supplied to the surface of the photosensitive drum 1 by the developing device 23, so that the electrostatic latent image is developed into a toner image.

The paper sheet in the paper feeding cassette 3 is taken out to the paper feeding path R by the paper feeding roller 41 in synchronism with the above described operations. This paper sheet is led to the registration rollers 42*a* and 42*b* on the paper feeding path R by the paper feeding roller 41 and the separation rollers 43*a* and 43*b*. The paper sheet is caused to wait once short of the photosensitive drum 1 by the registration rollers 42*a* and 42*b*. The registration rollers 42*a* and 42*b* are driven at the timing synchronized with the rotation of the photosensitive drum 1. Consequently, the paper sheet is fed to the photosensitive drum 1 at the timing when it is aligned with the toner image formed on the surface of the photosensitive drum 1 in the position where the transferrer 24 is provided.

The toner image formed on the surface of the photosensitive drum 1 is transferred onto the paper sheet by the transferrer 24. The paper sheet on which the toner image is transferred is separated from the surface of the photosensitive drum 1 by the separator 25. The paper sheet separated from the surface of the photosensitive drum 1 is led to the fixing section 5. In the fixing section 5, the toner on the surface of the paper sheet is fixed to the paper sheet by the heating roller 52 and the pressure roller 53. Thereafter, the surface of the photosensitive drum 1 is cleaned by the cleaner 26. In addition, the charges remaining on the surface of the photosensitive drum 1 are eliminated by the charge eliminating lamp 21.

Figure 2:
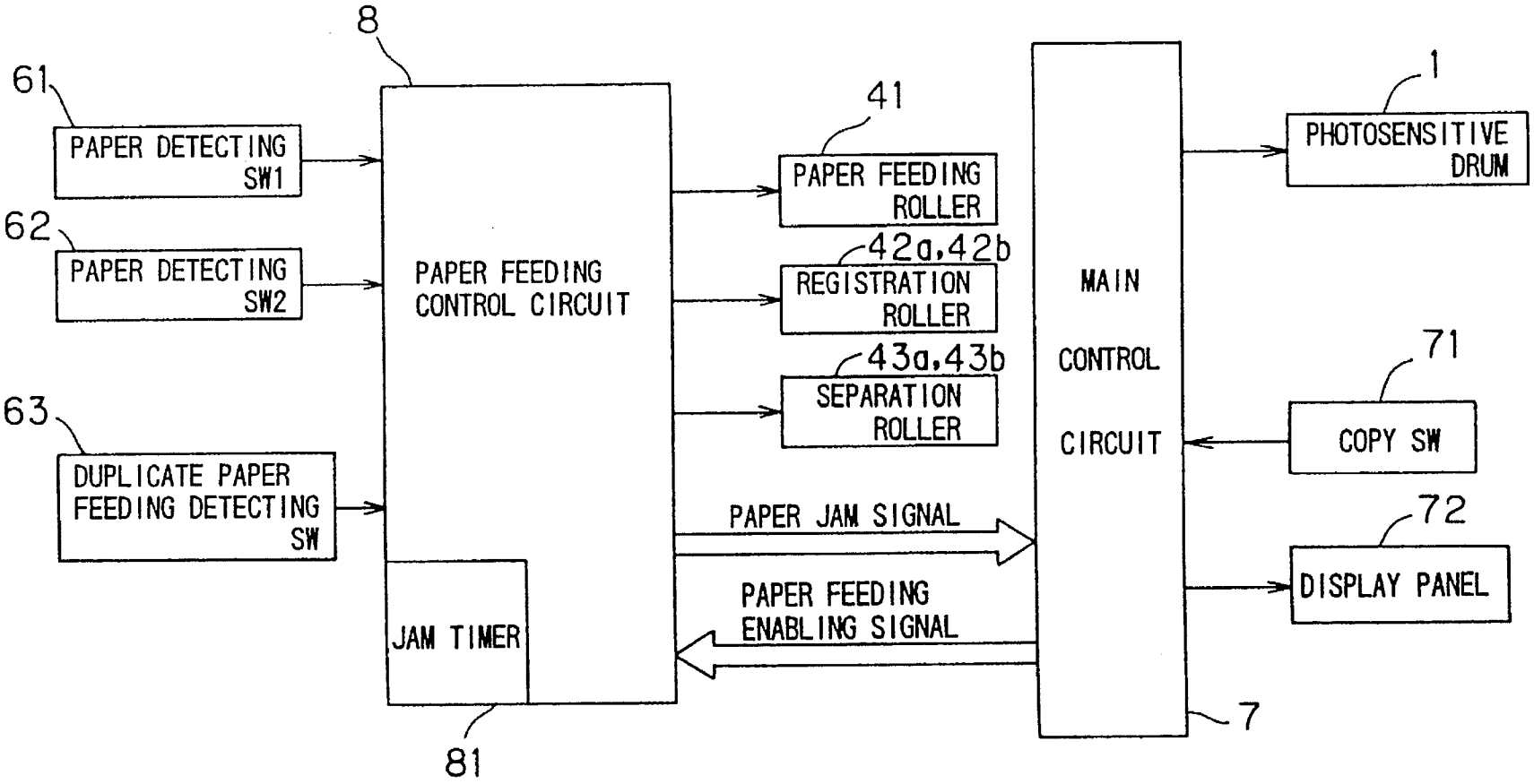
FIG. 2 is a block diagram showing the electrical construction of a control section.

FIG. 2 is a block diagram showing the electrical construction of a control section related to the above described copying machine. In FIG. 2, only portions related to paper feeding are illustrated. A paper feeding control circuit 8 conducting control related to paper feeding is connected to a main control circuit 7 conducting control of the entire copying machine. Both the control circuits 7 and 8 respectively comprise microcomputers each comprising a CPU (Central Processing Unit), a data RAM (Random Access Memory), and a program ROM (Read Only Memory). The control circuits 7 and 8 are respectively operated in accordance with programs previously stored in the program ROMs.

An operation signal of a copy switch 71, which is operated by an operator at the time when a copying operation is started is applied to the main control circuit 7. The main control circuit 7 controls the driving of the photosensitive drum 1 on the basis of this operation signal and applies a paper feeding enabling signal to the paper feeding control circuit 8.

The paper feeding control circuit 8 drives the paper feeding roller 41 when the paper feeding enabling signal from the main control circuit 7 is input. Consequently, paper feeding is started. Detection signals of the paper detecting switches 61 and 62 and the duplicate paper feeding detecting switch 63 are applied to the paper feeding control circuit 8. The paper feeding control circuit 8 controls the driving of the registration rollers 42*a* and 42*b* on the basis of the paper detection signals of the paper detecting switches 61 and 62, and also controls the driving of the separation rollers 43*a* and 43*b* and the paper feeding roller 41 on the basis of the detection signal of the duplicate paper feeding detecting switch 63.

Furthermore, the paper feeding control circuit 8 contains a JAM timer 81. The paper feeding control circuit 8 judges that a paper jam has occurred if both the first and second paper detecting switches 61 and 62 remain on after a time when the JAM timer 81 operates. The JAM timer 81 measures a predetermined time after the second paper detecting switch is turned on. The paper feeding control circuit 8 will then output to the main control circuit 7 a paper jam signal indicating that a paper jam has occurred.

The main control circuit 7 forces a copying operation to be stopped in response to input of the paper jam signal, and displays on a display panel 72 an indication that a paper jam has occurred. At this time, it is preferable that the position where the paper jam has occurred, along with the indication that the paper jam has occurred, is displayed on the display panel 72. The display panel 72 comprises, for example, a CRT (Cathode Ray Tube).

Figure 3:
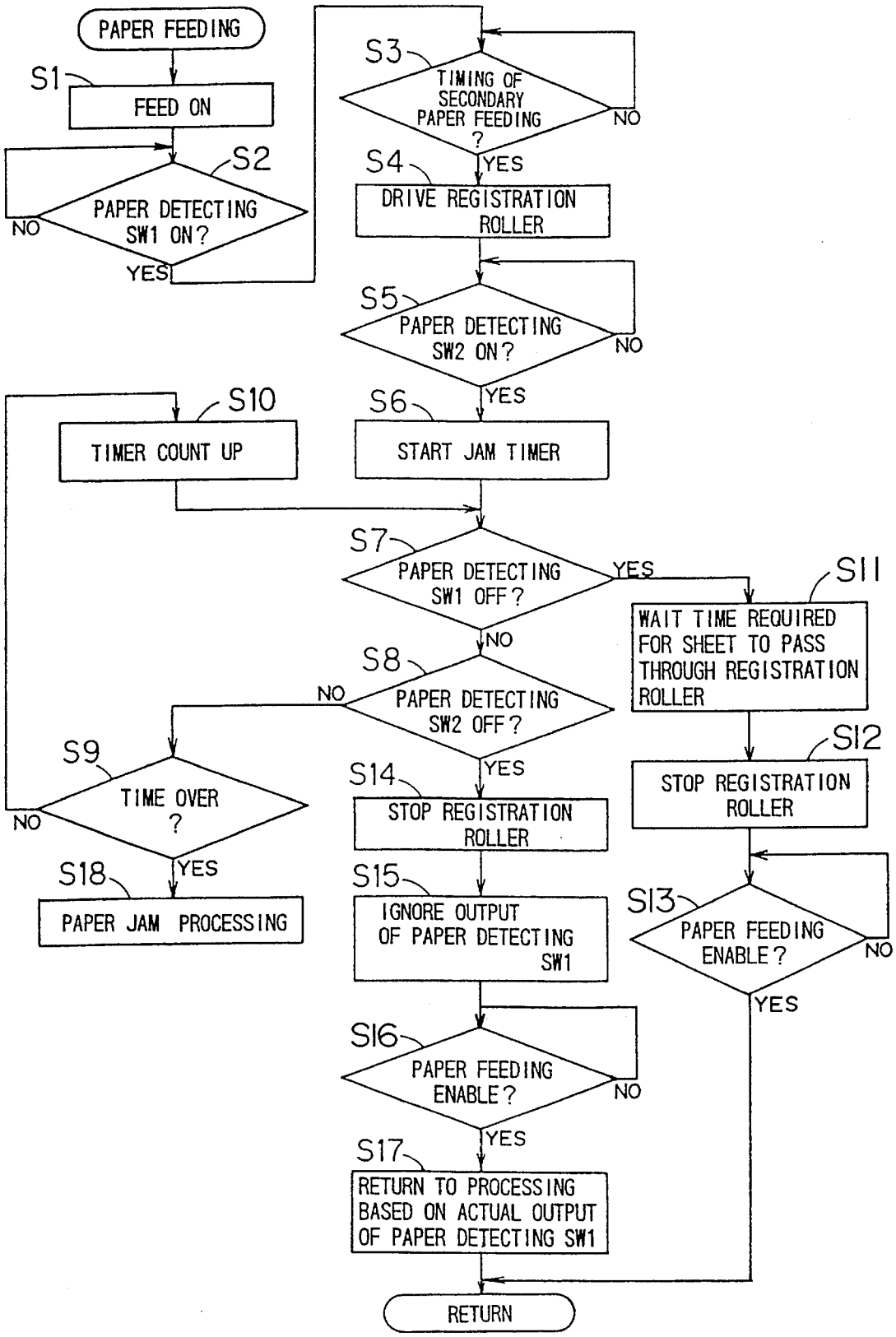
FIG. 3 is a flow chart showing control for paper feeding including control for judging that a paper jam has occurred.
Figure 4:
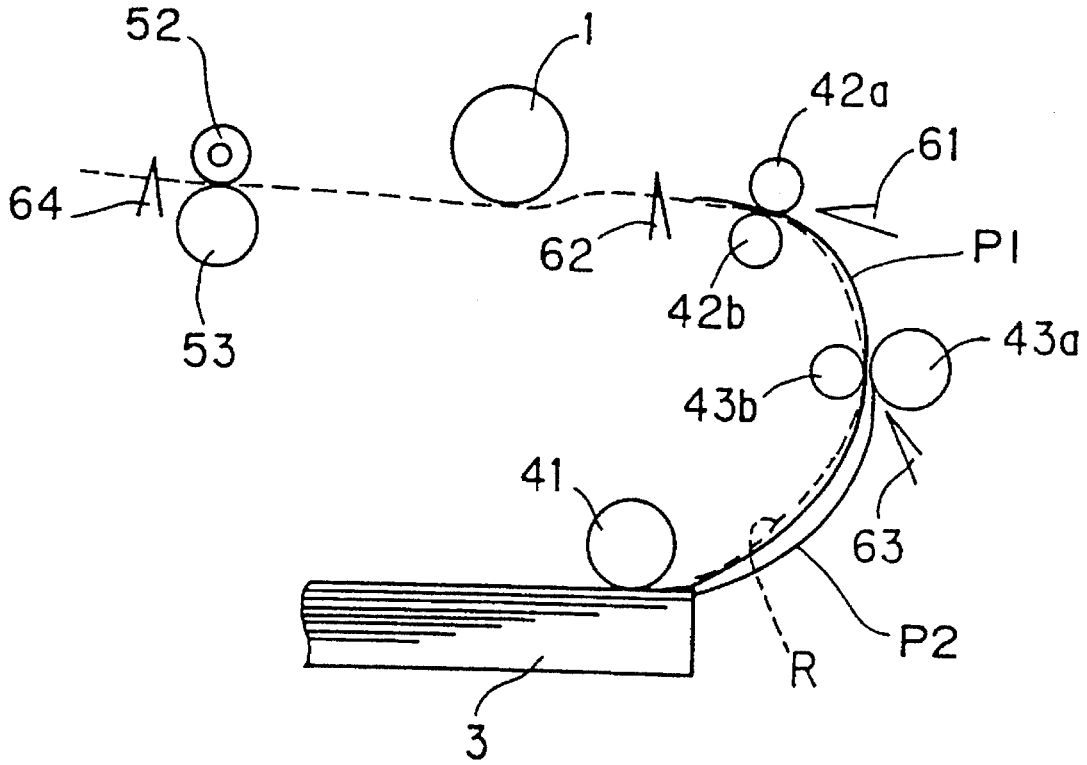
FIG. 4 is an illustration showing a state where only one paper sheet is fed to the registration rollers.
Figure 5A:
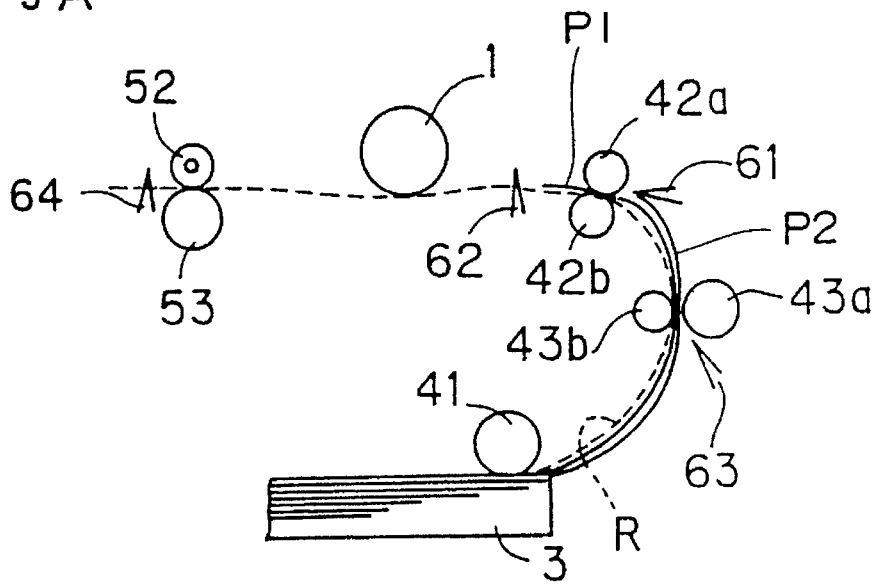
FIGS. 5A, 5B and 5C are illustrations for respectively explaining operations performed when a plurality of paper sheets are simultaneously fed in a duplicate paper feeding state to the registration rollers.
Figure 5B:
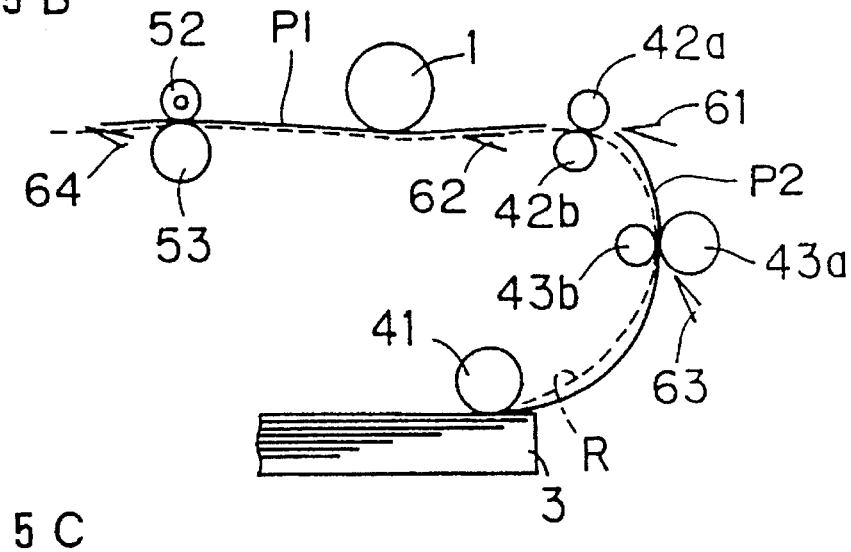
Figure 5C:
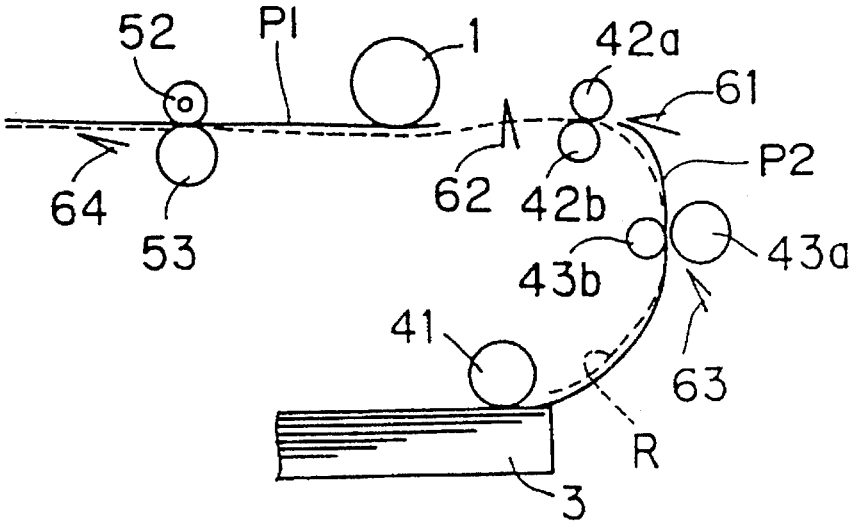

FIG. 3 is a flow chart showing the flow of control for paper feeding including control for judging that a paper jam has occurred. In FIG. 3, the contents of a program executed by the paper feeding control circuit 8 are shown. In addition, FIG. 4 is an illustration showing a state where the separation rollers 43 *a* and 43*b* normally function so that only one paper sheet is conveyed to the registration rollers 42*a* and 42*b*. FIGS. 5A, 5B and 5C are illustrations showing a state where the separation rollers 43*a* and 43*b* do not normally function so that paper sheets are simultaneously conveyed in a duplicate paper feeding state to the registration rollers 42*a* and 42*b*. In FIGS. 4, 5A, 5B and 5C, the illustration of components in the image forming section 2 is omitted.

Referring to FIG. 3, when the paper feeding enabling signal is input from the main control circuit 7 to the paper feeding control circuit 8, the driving of the paper feeding roller 41 is started, so that a paper sheet is fed to the photosensitive drum 1 from the paper feeding cassette 3 (step S1). When the leading edge of the paper sheet taken out of the paper feeding cassette 3 reaches the duplicate paper feeding detecting switch 63 to incline the actuator thereof, the duplicate paper feeding detecting switch 63 is turned on. The paper feeding control circuit 8 starts to drive the separation rollers 43*a* and 43*b* in response to the switching of the duplicate paper feeding detecting switch 63 to an ON state. Consequently, the paper sheet is further conveyed to the registration rollers 42*a* and 42*b* .

When the leading edge of the paper sheet reaches the first paper detecting switch 61, the first paper detecting switch 61 is switched from an OFF state to an ON state (step S2). Driving of the paper feeding roller 41 is stopped when the time required for the leading edge of the paper sheet to reach the registration rollers 42*a* and 42*b* has elapsed after the paper detecting switch 61 is turned on, When the leading edge reaches the registration rollers 42*a* and 42*b*, the paper sheet is caused to wait once. Thereafter, at a predetermined timing of the secondary paper feeding (step S3), the driving of the registration rollers 42*a* and 42*b* is started (step S4). In the above described manner, the paper sheet is fed to the photosensitive drum 1.

The timing of secondary paper feeding is selected such that when the driving of the registration rollers 42*a* and 42*b* is to be started, a toner image formed on the surface of the photosensitive drum 1 is aligned with the paper sheet at the transferrer 24.

When the leading edge of the paper sheet fed to the photosensitive drum 1 from the registration rollers 42*a* and 42*b* reaches the second paper detecting switch 62, the second paper detecting switch 62 is switched from an OFF state to an ON state. When the second paper detecting switch 62 is switched from an OFF state to an ON state, the measurement of time by the JAM timer 81 is started (steps S5 and S6).

The first paper detecting switch 61 and the second paper detecting switch 62 are monitored to determine whether or not they are turned off (steps S7 and S8). If both the paper detecting switches 61 and 62 are turned on, it is judged whether or not the measurement of the predetermined time is terminated (step S9). This predetermined time is set to a time approximately equal to (preferably, slightly longer than) the time required for the paper sheet to pass through the second paper detecting switch 62.

When in step S9 it is judged that the time measured by the JAM timer 81 is not the above described predetermined time or more, the time measured by the JAM timer 81 is incremented (step S10) and then, the program is returned to step S7. In a case where both the paper detecting switches 61 5 and 62 continue being in an ON state during the above described predetermined time, it is judged that a paper jam has occurred, and the image forming apparatus performs paper jam processing (step S18). In the paper jam processing, a copying operation is forced to be stopped, and the indication that a paper jam has occurred and/or the position where a paper jam has occurred are displayed on the display panel 72.

If either one of the paper detecting switches 61 and 62 is switched from an ON state to an OFF state before the JAM timer 81 measures the predetermined time, it is not judged that a paper jam has occurred. For example, a state shown in FIG. 4 may occur. Specifically, two paper sheets P1 and P2 are taken out to the paper feeding path R from the paper feeding cassette 3. The two paper sheets P1 and P2 are separated by the separation rollers 43*a* and 43*b*, so that only the paper sheet P1 on the side of the small diameter roller 43*b* is conveyed to the registration rollers 42*a* and 42*b*, while the paper sheet P2 on the side of the large diameter roller 43*a* is prevented from being conveyed at the separation rollers 43*a* and 43*b*.

In this case, only the one paper sheet P1 is fed to the photosensitive drum 1 through the registration rollers 42*a* and 42*b*. Therefore, the first paper detecting switch 61 is switched from an ON state to an OFF state before the JAM timer 81 measures the predetermined time. Therefore, processing is transferred from the step S7 to the step S11. Specifically, the driving of the registration rollers 42*a* and 42*b* is stopped (step S12) after the time required for the paper sheet to pass through the registration rollers 42*a* and 42*b* has elapsed (step S11).

Thereafter, if a paper feeding enabling signal corresponding to the subsequent copying is applied, processing in the step S1 and the subsequent steps is performed (step S13).

A state shown in FIGS. 5A–5C also may occur. Specifically, as shown in FIG. 5A, the separation rollers 43*a* and 43*b* do not normally function so that the two paper sheets P1 and P2 are simultaneously conveyed in a duplicate paper feeding state to the registration rollers 42*a* and 42*b*. If only the first paper sheet P1 is conveyed to the photosensitive drum 1 by the registration rollers 42*a* and 42*b*, the state shown in FIG. 5A is changed into a state shown in FIG. 5B. Specifically, the leading edge of the first paper sheet P1 reaches the second paper detecting switch 62, to switch the second paper detecting switch 62 from an OFF state to an ON state. At this time point, a measuring operation performed by the JAM timer 81 is started.

Thereafter, as shown in FIG. 5C, the first paper sheet P1 is conveyed to the heating roller 52 and the pressure roller 53 after the toner image is transferred on the surface thereof. Consequently, the second paper detecting switch 62 is switched from an ON state to an OFF state. At this time, the first paper detecting switch 61 is held in an ON state by the second paper sheet P2 even after the JAM timer 81 has measured the above described predetermined time. In this case, it is judged that paper sheets are simultaneously fed in a duplicate paper feeding state inside the paper feeding control circuit 8. Specifically, when the first paper detecting switch 61 is turned on at the time point where a predetermined time has elapsed since the registration rollers 42*a* and 42*b* started to feed the paper sheet, it is judged that a duplicate paper feeding state has occurred.

It is one paper sheet that passes through the registration rollers 42*a* and 42*b*. Accordingly, the second paper detecting switch 62 is turned off before the JAM timer 81 measures the above described predetermined time. Therefore, processing performed by the paper feeding control circuit 8 branches from step S8 to step S14 shown in FIG. 3. Specifically, paper jam processing in the step S18 is not performed.

In step S14, the driving of the registration rollers 42*a* and 42*b* is stopped. The actual output of the first paper detecting switch 61 is ignored, so that processing is performed by forcedly considering that the first paper detecting switch 61 is turned off (step S15).

Thereafter, if a paper feeding enabling signal for the subsequent copying is applied (step S16), the program is returned to processing based on the actual output of the first paper detecting switch 61 (step S17), so that the processing in step S1 and the subsequent steps is performed.

In the copying machine according to the present embodiment, therefore, it is judged that paper sheets are fed one at a time when the first paper detecting switch 61 is turned off before a predetermined time has elapsed since the registration rollers 42*a* and 42*b* were driven to turn the second paper detecting switch 62 on. In addition, it is judged that a duplicate paper feeding state has occured when the first paper detecting switch 61 is not turned off even if a predetermined time has elapsed since the second paper detecting switch 62 was turned on. If the second paper detecting switch 62 is not turned off when it is judged that a duplicate paper feeding state has occurred, it is judged that a paper jam has occurred. 0n the other hand, if the second paper detecting switch 62 is turned off when it is judged that a duplicate paper feeding state has occurred it is judged that the paper sheets are simultaneously fed in a duplicate paper feeding state. In this case, the paper jam processing (step S18) is not performed, so that the second paper sheet out of the paper sheets which are simultaneously fed in a duplicate paper feeding state is fed after the driving of the registration rollers 42*a* and 42*b* is stopped once.

Even if there has occurred a state where the first paper detecting switch 61 continues to be turned on due to the presence of the second paper sheet after the first paper sheet passes through the first paper detecting switch 61, the state is not judged to be a state where a paper jam has occurred. The second paper sheet as well as the first one is fed to the photosensitive drum 1. Consequently, both of the two paper sheets which are simultaneously fed in a duplicate paper feeding state can be fed to the photosensitive drum 1 without erroneously judging that a paper jam has occurred. As a result, the reliability of the judgment that a paper jam has occurred is improved. Moreover, it is possible to save time and labor caused by the erroneous judgment that a paper jam has occurred. In addition, it is possible to reliably use intact paper sheets for recording an image, so that paper sheets are not wasted.

Although description was made of the embodiment of the present invention, the present invention is not limited to the above described embodiment. For example, although in the above described embodiment, description was made of a copying machine provided with separation rollers, separation rollers need not be necessarily provided.

Furthermore, although in the above described embodiment, a mechanical paper detecting switch is used for detecting the paper sheet conveyed on the paper feeding path R, the paper sheet may be detected by an alternative construction. For example, a light emitting device and a light receiving device which form a pair may be disposed so as to be opposed to each other with the paper feeding path R being interposed therebetween, to detect the presence or absence of the paper sheet on the basis of the judgment as to whether or not light from the light emitting device is received by the light receiving device.

Additionally, the present invention is also applicable to an image forming apparatus such as a printer, in addition to a copying machine.

Although the present invention has been described and illustrated in detail, the foregoing descriptions are mere specific examples to illustrate the technological aspects of the present invention, and the present invention should not be taken in a narrow sense by limiting its scope to these examples. The spirit and scope of the present invention should be limited only by the terms of the appended claims.

What is claimed is:

1. A paper feeding device which is provided for an image forming apparatus having an image forming section for recording an image on a paper sheet, comprising:

a registration roller provided on a paper feeding path on which a paper sheet fed to the image forming section is conveyed in a paper conveyance direction, the registration roller provided for feeding the paper sheet to the image forming section at a predetermined timing;

first detecting means for detecting the paper sheet in a predetermined position on the paper feeding path on an upstream side of said registration roller with respect to the paper conveyance direction;

second detecting means for detecting the paper sheet conveyed to the image forming section in a predetermined position on the paper feeding path on a downstream side of said registration roller with respect to the paper conveyance direction;

duplicate paper feeding judging means for judging that a duplicate paper feeding state has occurred where a plurality of paper sheets are simultaneously fed to said registration roller, wherein the duplicate paper feeding judging means will judge that a duplicate paper feeding state has occurred if said first detecting means detects a paper sheet after a predetermined time has elapsed since said registration roller started to feed the paper sheet;

paper jam judging means for judging that a paper jam occurs on the basis of the fact that said second detecting means detects a paper sheet after the predetermined time, when said duplicate paper feeding judging means judges that a duplicate paper feeding state has occurred; and paper feeding control means for stopping said registration roller once so as to feed a subsequent paper sheet on the basis of the fact that said second detecting means does not detect a paper sheet when said duplicate paper feeding judging means judges that a duplicate paper feeding state has occurred.

2. A paper feeding device according to claim 1, further comprising means for stopping said registration roller in preparation for feeding the subsequent paper sheet, if said first detecting means does not detect a paper sheet after said predetermined time has elapsed since said registration roller started to feed the paper sheet.

3. A paper feeding device according to claim 1, wherein:

said predetermined time is approximately equal to a time required for a paper sheet fed to the image forming section by said registration roller to pass through the predetermined position where said second detecting means detects the paper sheet.

4. A paper feeding device according to claim 1, wherein:

said first detecting means is a paper detecting switch including an actuator which is driven by the paper sheet conveyed on said paper feeding path.

5. A paper feeding device according to claim 1, wherein:

said second detecting means is a paper detecting switch including an actuator which is driven by the paper sheet conveyed on said paper feeding path.

6. A paper feeding device according to claim 1, further comprising:

a pair of separation rollers provided on said paper feeding path on an upstream side of said first detecting means with respect to the paper conveyance direction, said separation rollers provided for separating a plurality of paper sheets which are simultaneously fed in a duplicate paper feeding state, so as to feed the paper sheets one at a time to said registration roller.

7. A paper jam judging method which is applied to an image forming apparatus having an image forming section for recording an image on a paper sheet and a registration roller provided on a paper feeding path on which a paper sheet fed to the image forming section is conveyed for feeding the paper sheet to the image forming section at a predetermined timing, said method comprising:

detecting a paper sheet in a first predetermined position on the paper feeding path on an upstream side of said registration roller with respect to a paper conveyance direction in which the paper sheet is conveyed toward the image forming section;

detecting a paper sheet conveyed to the image forming section in a second predetermined position on the paper feeding path, said second predetermined position being a position between the registration roller and the image forming section; and judging that a paper jam has occurred on the basis of the fact that a paper sheet is detected in said first predetermined position and a paper sheet is detected in said second predetermined position when a predetermined time has elapsed since said registration roller started to feed a paper sheet.

8. A paper feeding device for an image forming apparatus having an image forming section for recording an image on a paper sheet, comprising:

a registration roller provided on a paper feeding path on which a paper sheet fed to the image forming section is conveyed in a paper conveyance direction, the registration roller provided for feeding a paper sheet to the image forming section at a predetermined timing;

first detecting means for detecting a paper sheet in a predetermined position on the paper feeding path on an upstream side of the registration roller with respect to the paper conveyance direction;

second detecting means for detecting a paper sheet conveyed to the image forming section in a predetermined position on the paper feeding path on a downstream side of the registration roller with respect to the paper conveyance direction, the second detecting means provided for detecting a paper sheet on the paper feeding path between the registration roller and the image forming section;

duplicate paper feeding judging means for judging that a duplicate paper feeding state has occurred where a plurality of paper sheets are simultaneously fed to the registration roller, wherein the duplicate paper feeding judging means will judge that a duplicate paper feeding state has occurred if the first detecting means detects a paper sheet after a predetermined time from a time when the registration roller started to feed a paper sheet;

paper jam judging means for judging that a paper jam has occurred, wherein if the second detecting means detects a paper sheet after the predetermined time, and if the duplicate paper feeding judging means judges that a duplicate paper feeding state has occurred, then the paper jam judging means will judge that a paper jam has occurred; and paper feeding control means for stopping the registration roller from feeding a subsequent paper sheet if the second detecting means does not detect a paper sheet after the predetermined time, if the duplicate paper feeding judging means has judged that a duplicate paper feeding state has occurred.

9. A paper feeding device according to claim 8, further comprising:

means for stopping the registration roller in preparation for feeding a subsequent paper sheet, if the first detecting means does not detect a paper sheet after the predetermined time has elapsed since the registration roller started to feed the paper sheet.

10. A paper feeding device according to claim 8, wherein:

the predetermined time is approximately equal to a time required for a paper sheet fed to the image forming section by the registration roller to pass through the predetermined position where the second detecting means detects the paper sheet.

11. A paper feeding device according to claim 8, wherein:

the first detecting means is a paper detecting switch including an actuator which is driven by the paper sheet conveyed on the paper feeding path.

12. A paper feeding device according to claim 8, wherein:

the second detecting means is a paper detecting switch including an actuator which is driven by the paper sheet conveyed on the paper feeding path.

13. A paper feeding device according to claim 8, further comprising:

a pair of separation rollers provided on the paper feeding path on an upstream side of the first detecting means with respect to the paper conveyance direction, the separation rollers provided for separating a plurality of paper sheets which are simultaneously fed in a duplicate paper feeding state, such that one paper sheet at a time is fed to the registration roller.

* * * * *